US006832753B1

(12) United States Patent
Huang

(10) Patent No.: US 6,832,753 B1
(45) Date of Patent: Dec. 21, 2004

(54) HUMIDIFIER WITH A WATER WHEEL DEVICE

(75) Inventor: Kuo-Fu Huang, Tainan (TW)

(73) Assignee: Royal-G Enterprise Co., Ltd. (TW)

( * ) Notice: Subject to any disclaimer, the term of this patent is extended or adjusted under 35 U.S.C. 154(b) by 0 days.

(21) Appl. No.: 10/650,242

(22) Filed: Aug. 28, 2003

(51) Int. Cl.[7] ..... B01F 3/04
(52) U.S. Cl. ..... 261/28; 261/72.1; 261/92
(58) Field of Search ..... 261/28, 29, 72.1, 261/92, DIG. 65

(56) References Cited

U.S. PATENT DOCUMENTS 1,786,200 A * 12/1930 Ferguson ..... 261/30
1,805,963 A * 5/1931 Toncray ..... 261/92
1,961,508 A * 6/1934 Persons ..... 261/92
2,013,270 A * 9/1935 Grady ..... 261/92
2,253,418 A * 8/1941 Crandall et al. ..... 261/92
3,799,517 A * 3/1974 Tamm ..... 261/128
3,948,627 A * 4/1976 Schwarz et al. ..... 96/283
4,222,971 A * 9/1980 Eilert ..... 261/92
4,385,987 A * 5/1983 McGinley et al. ..... 210/150
5,483,616 A * 1/1996 Chiu et al. ..... 392/406
5,611,967 A * 3/1997 Jane et al. ..... 261/142
5,783,117 A * 7/1998 Byassee et al. ..... 261/29

* cited by examiner

*Primary Examiner*—Scott Bushey
(74) *Attorney, Agent, or Firm*—Ostrolenk, Faber, Gerb & Soffen, LLP

(57) ABSTRACT

A humidifier includes a humidifier housing, a fan, and a water wheel device. The humidifier housing includes a lower base member that defines a liquid-containing compartment, and an upper cover member mounted on the lower base member and formed with a vapor outlet. The fan is mounted in the upper cover member, and is operable so as to generate air currents that flow through the vapor outlet. The water wheel device includes a horizontal wheel axle mounted rotatably in the humidifier housing, a drive motor for driving axial rotation of the wheel axle, and a plurality of disc members mounted spacedly and co-rotatably on the wheel axle. Each of the disc members has a lower disc portion extending into the liquid-containing compartment, and an upper disc portion disposed under and adjacent to the fan.

9 Claims, 4 Drawing Sheets

HUMIDIFIER WITH A WATER WHEEL DEVICE

BACKGROUND OF THE INVENTION

1. Field of the Invention

The present invention relates to a humidifier, more particularly to a humidifier with a water wheel device.

2. Description of the Related Art

Conventional humidifiers, which transform water into vapor with the use of a high frequency vibrating device, are known in the art. However, since the constructions of such humidifiers are relatively complicated, high manufacturing costs are incurred, and repair and maintenance of the same are difficult to conduct.

SUMMARY OF THE INVENTION

Therefore, the object of the present invention is to provide a humidifier with a water wheel device that can overcome the aforesaid drawbacks associated with the prior art.

Accordingly, a humidifier of the present invention comprises a humidifier housing, a fan, and a water wheel device. The humidifier housing includes a lower base member and an upper cover member mounted on top of the lower base member. The lower base member defines a liquid-containing compartment that opens upwardly. The upper cover member defines a fan-mounting space that is disposed above the liquid-containing compartment, and is formed with a vapor outlet. The humidifier housing further defines a wheel-receiving space between the liquid-containing compartment and the fan-mounting space. The fan is mounted in the fan-mounting space and is operable so as to generate air currents that flow out of the humidifier housing through the vapor outlet. The water wheel device includes a horizontal wheel axle, a drive motor, and a plurality of disc members. The horizontal wheel axle is mounted rotatably in the wheel-receiving space. The drive motor is mounted to the humidifier housing and is coupled to the wheel axle for driving axial rotation of the wheel axle. Each of the disc members is mounted spacedly and co-rotatably on the wheel axle, and has a lower disc portion extending into the liquid-containing compartment, and an upper disc portion disposed under and adjacent to the fan. Accordingly, liquid contained in the liquid-containing compartment is agitated when the disc members rotate, and is subsequently vaporized by the air currents generated by the fan.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
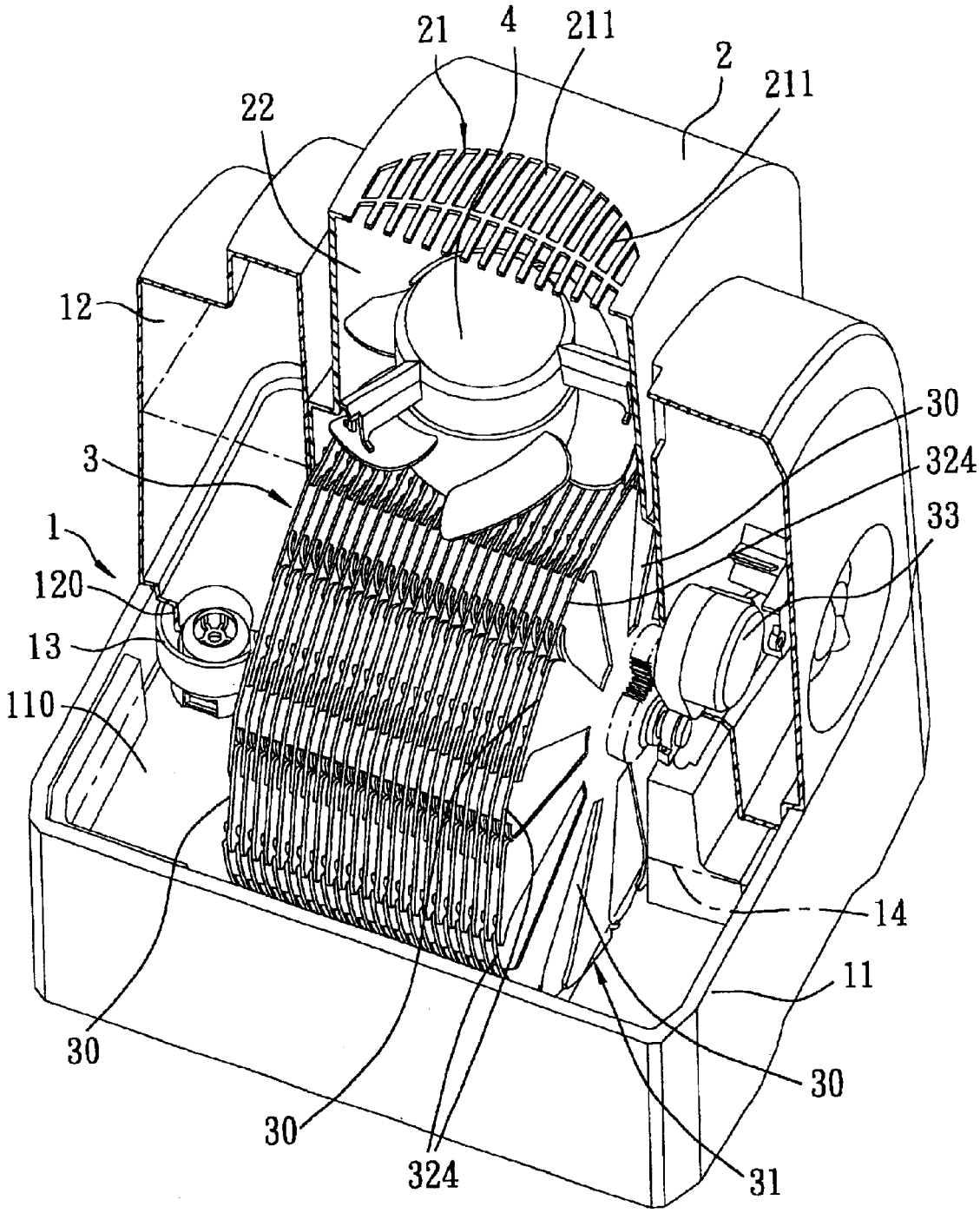
FIG. 1 is a partly cutaway, assembled perspective view of the preferred embodiment of a humidifier according to the present invention.

Referring to FIG. 1, the preferred embodiment of a humidifier according to the present invention is shown to include a humidifier housing 1, a fan 4, and a water wheel device 3.

Figure 3:
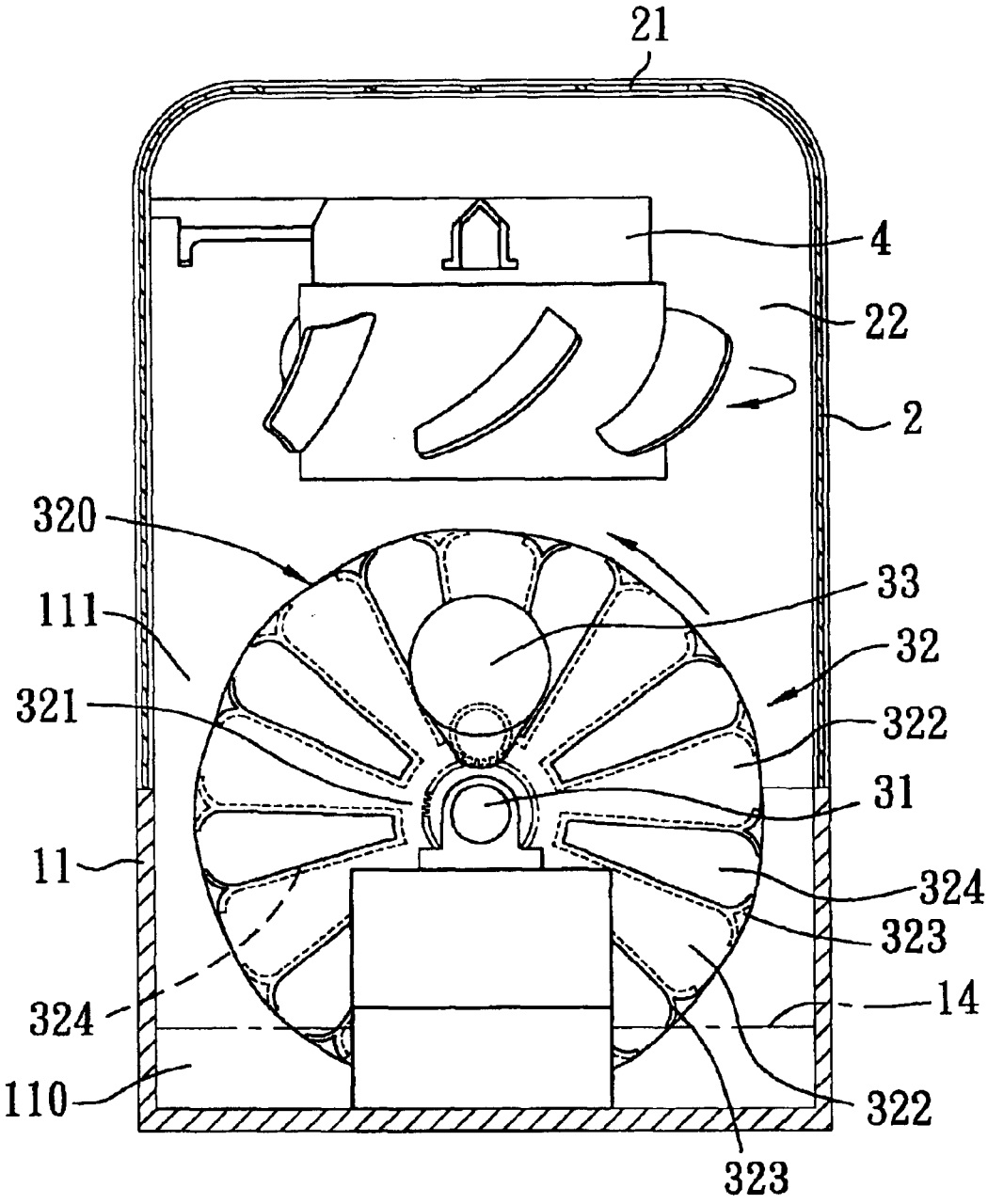
FIG. 3 is a partly sectional, schematic end view of the preferred embodiment.
Figure 4:
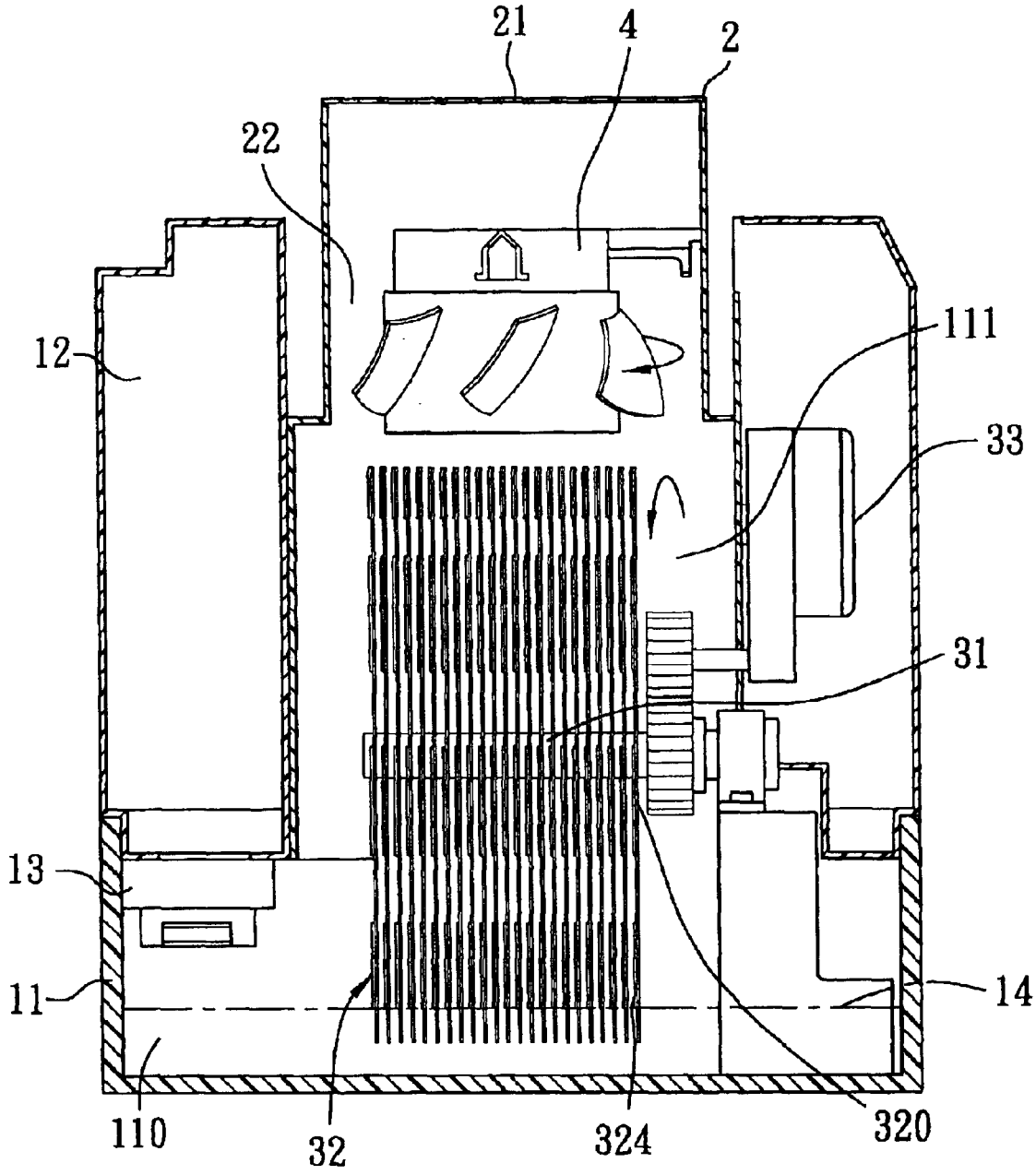
FIG. 4 is a partly sectional, schematic side view of the preferred embodiment.

The humidifier housing 1 includes a lower base member 11 and an upper cover member 2 mounted on top of the lower base member 11. The lower base member 11 defines a liquid-containing compartment 110 that opens upwardly. The upper cover member 2 defines a fan-mounting space 22 that is disposed above the liquid-containing compartment 110, and is formed with a vapor outlet 21. The humidifier housing 1 further defines a wheel-receiving space 111 between the liquid-containing compartment 110 and the fan-mounting space 22, as best shown in FIGS. 3 and 4.

In this embodiment, the vapor outlet 21 is formed through a top wall of the upper cover member 2 but should not be limited thereto. Particularly, the exact location of the vapor outlet 21 in the upper cover member 2 may vary depending on actual design requirements. Moreover, in this embodiment, the vapor outlet 21 consists of a plurality of vent holes 211 but should not be limited thereto. The purpose of the vapor outlet 21 is still served when it consists of a single vent hole.

The humidifier housing 1 further includes a supply tank 12 mounted on top of the lower base member 11 and disposed beside the upper cover member 2. Preferably, the supply tank 12 is mounted removably on the lower base member 11. More preferably, the lower base member 11 has an open top side, and the upper cover member 2 and the supply tank 12 cooperate to seal the open top side of the lower base member 11. The supply tank 12 is adapted for containing liquid that is to be supplied to the liquid-containing compartment 110, and is formed with a liquid outlet 120. The humidifier further comprises a known control valve 13 mounted in the liquid outlet 120 and responsive to liquid level 14 in the liquid-containing compartment 110 to control fluid communication between the liquid outlet 120 and the liquid-containing compartment 110 to as to maintain the liquid level 14 at an appropriate level. Since the control valve 13 is well known to those skilled in the art, a detailed description of the same is dispensed with herein for the sake of brevity.

The fan 4 is mounted in the fan-mounting space 22 of the upper cover member 2, and is operable so as to generate air currents that flow out of the humidifier housing 1 through the vapor outlet 21 in the upper cover member 2.

Figure 2:
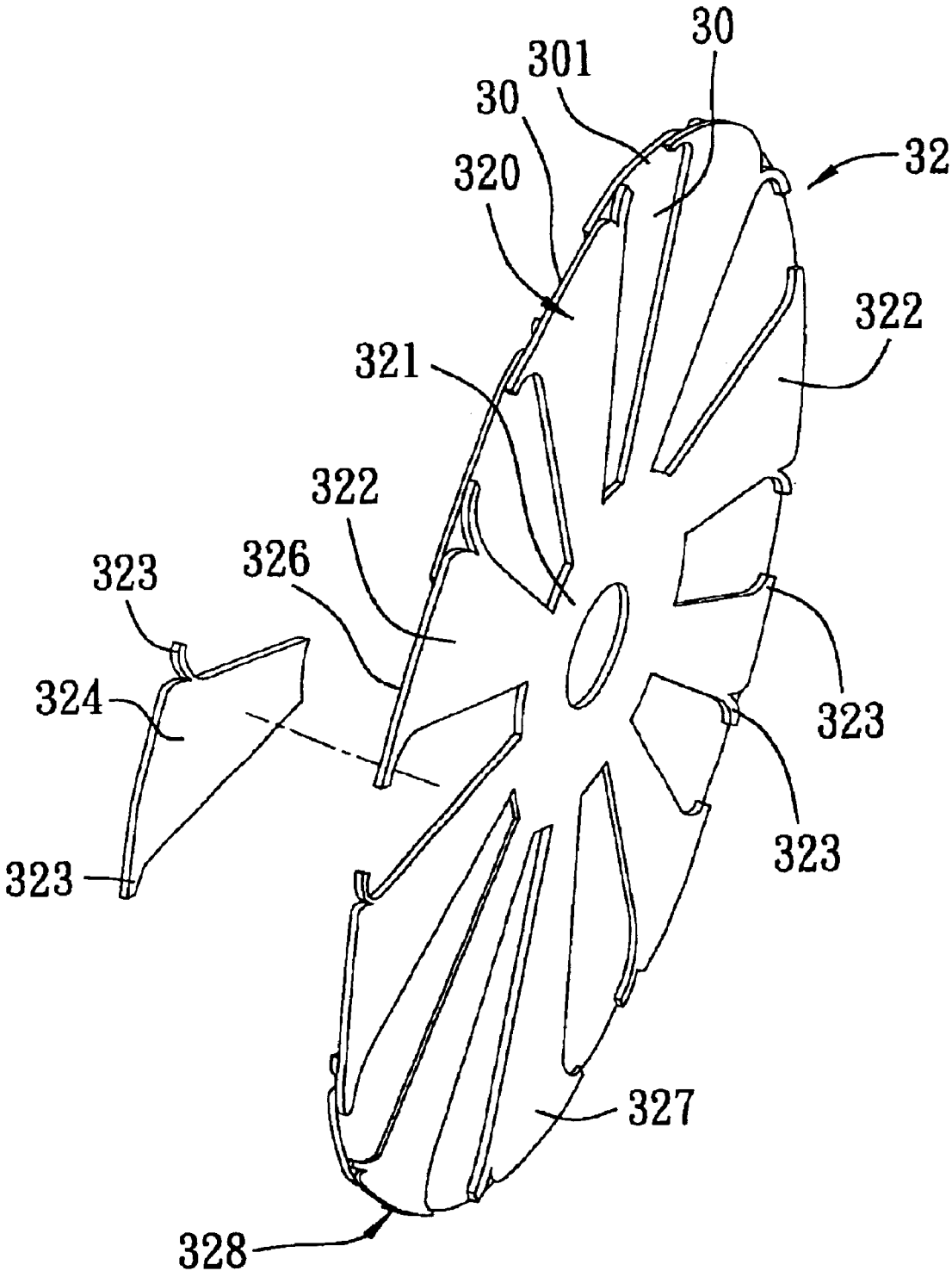
FIG. 2 is a partly exploded, perspective view of a disc member of a water wheel device of the preferred embodiment.

With further reference to FIGS. 2 to 4, the water wheel device 3 includes a horizontal wheel axle 31, a drive motor 33, and a plurality of disc members 32.

The horizontal wheel axle 31 is mounted rotatably in the wheel-receiving space 111 of the humidifier housing 1. The drive motor 33 is mounted in the upper wheel cover 2 of the humidifier housing 1, and is coupled to the wheel axle 31 for driving axial rotation of the wheel axle 31. The disc members 32 are mounted spacedly and co-rotatably on the wheel axle 31. Each of the disc members 32 has a lower disc portion extending into the liquid-containing compartment 110, and an upper disc portion disposed under and adjacent to the fan 4.

As best shown in FIG. 2, each of the disc members 32 includes a disc body 320 and a cover unit 328. The disc body 320 has an axle mounting portion 321 mounted on the wheel axle 31, and a plurality of disc extension portions 322 that extend in radial outward directions from the axle mounting portion 321 and that are angularly spaced apart from each other. The disc body 320 has first and second sides 326, 327.

The cover unit 328 is mounted on the first side 326 of the disc body 320, and cooperates with the disc body 320 to form a plurality of first liquid-receiving recesses 30 in the second side 327 of the disc body 320. Each of the first liquid-receiving recesses 30 is disposed between a corresponding adjacent pair of the disc extension portions 322, has a width that is gradually increased in a direction away from the wheel axle 31, and opens at a periphery of the disc body 320. Preferably, adjacent ones of the disc extension portions 322 are formed with end protrusions 323 that cooperate to form a restricted access opening 301 into the corresponding one of the first liquid-receiving recesses 30 at the periphery of the disc body 320.

In this embodiment, the cover unit 328 includes a plurality of cover plates 324, each of which extends between an adjacent pair of the disc extension portions 322. The cover plates 324 further cooperate with the disc body 320 to form a plurality of second liquid-receiving recesses 30 in the first side 326 of the disc body 320. Each of the second liquid-receiving recesses 30 is disposed between a corresponding adjacent pair of the cover plates 324, and has a shape similar to that of the first liquid-receiving recesses 30, i.e., each of the second liquid-receiving recesses 30 has a width that is gradually increased in a direction away from the wheel axle 31 and opens at a periphery of the disc body 320. Likewise, adjacent ones of the cover plates 324 are formed with end protrusions 323 that cooperate to form a restricted access opening 301 into the corresponding one of the second liquid-receiving recesses 30 at the periphery of the disc body 320.

In practice, the specific configuration of the disc members 32 is not limited to that of the preferred embodiment. For example, it is possible to form the liquid-receiving recesses in one side or in both sides of the disc member using casting techniques.

The liquid-receiving recesses 30 in the disc members 32 serve the purpose of moving the liquid contained in the liquid-containing compartment 110 toward the fan 4 when the disc members 32 rotate. Therefore, the liquid contained in the liquid-containing compartment 110 is agitated when the disc members 32 rotate, and is subsequently vaporized by the air currents generated by the fan 4. The air currents that flow out of the humidifier housing 1 through the vapor outlet 21 can accordingly increase humidity of the surrounding environment.

As the liquid level 14 in the liquid-containing compartment 110 drops due to the cooperative action of the water wheel device 3 and the fan 4, the control valve 13 will permit liquid flow through the liquid outlet 120 for supplying liquid from the supply tank 12 to the liquid-containing compartment 110 so as to maintain the liquid level 14 in the liquid-containing compartment 110 at an appropriate level.

It is apparent from the foregoing that the humidifier of the present invention has a relatively simple construction that involves lower manufacturing costs and that is relatively easy to maintain and repair. The object of the present invention is thus met.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A humidifier comprising:

a humidifier housing including a lower base member and an upper cover member mounted on top of said lower base member, said lower base member defining a liquid-containing compartment that opens upwardly, said upper cover member defining a fan-mounting space that is disposed above said liquid-containing compartment and being formed with a vapor outlet, said humidifier housing further defining a wheel-receiving space between said liquid-containing compartment and said fan-mounting space;

a fan mounted in said fan-mounting space and operable so as to generate air currents that flow out of said humidifier housing through said vapor outlet; and a water wheel device including a horizontal wheel axle mounted rotatably in said wheel-receiving space, a drive motor mounted to said humidifier housing and coupled to said wheel axle for driving axial rotation of said wheel axle, and a plurality of disc members mounted spacedly and co-rotatably on said wheel axle, each of said disc members having a lower disc portion extending into said liquid-containing compartment, and an upper disc portion disposed under and adjacent to said fan;

each of said disc members includes:

a disc body having an axle mounting portion mounted on said wheel axle, and a plurality of disc extension portions that extend in radially outward directions from said axle mounting portion and that are angularly spaced apart from each other, said disc body having first and second sides; and a cover unit mounted on said first side of said disc body and cooperating with said disc body to form a plurality of first liquid-receiving recesses in said second side of said disc body, each of said first liquid-receiving recesses being disposed between a corresponding adjacent pair of said disc extension portions;

said cover unit includes a plurality of cover plates, each said cover plate extends between an adjacent pair of said disc extension portions, said cover plates further cooperating with said disc body to form a plurality of second liquid-receiving recesses in said first side of said disc body, each of said second liquid-receiving recesses being disposed between a corresponding adjacent pair of said cover plates;

each of said second liquid-receiving recesses has a width that is gradually increased in a direction away from said wheel axle and opens at a periphery of said disc body;

adjacent ones of said cover plates are formed with end protrusions that cooperate to form a restricted access opening into the corresponding one of said second liquid-receiving recesses at the periphery of said disc body;

whereby liquid contained in said liquid-containing compartment is agitated when said disc members rotate and is subsequently vaporized by the air currents generated by said fan.

2. The humidifier as claimed in claim 1, wherein each of said disc members has one side formed with a plurality of liquid-receiving recesses adapted for moving the liquid contained in said liquid-containing compartment toward said fan when said disc members rotate.

3. The humidifier as claimed in claim 1, wherein each of said disc members has opposite sides formed with a plurality of liquid-receiving recesses adapted for moving the liquid contained in said liquid-containing compartment toward said fan when said disc members rotate.

4. The humidifier as claimed in claim 1, wherein each of said first liquid-receiving recesses has a width that is gradually increased in a direction away from said wheel axle, and opens at a periphery of said disc body.

5. The humidifier as claimed in claim 4, wherein adjacent ones of said disc extension portions are formed with end protrusions that cooperate to form a restricted access opening into the corresponding one of said first liquid-receiving recesses at the periphery of said disc body.

6. The humidifier as claimed in claim 1, wherein said humidifier housing further includes a supply tank mounted on top of said lower base member and disposed beside said upper cover member, said supply tank being adapted for containing the liquid that is to be supplied to said liquid-containing compartment, said supply tank being formed with a liquid outlet, said humidifier further comprising a control valve mounted in said liquid outlet and responsive to liquid level in said liquid-containing compartment to control fluid communication between said liquid outlet and said liquid-containing compartment so as to maintain the liquid level at an appropriate level.

7. The humidifier as claimed in claim 6, wherein said supply tank is mounted removably on said lower base member.

8. The humidifier as claimed in claim 6, wherein said lower base member has an open top side, and said cover member and said supply tank cooperate to seal said open top side of said lower base member.

9. A humidifier comprising:

a humidifier housing including a lower base member defining a liquid-containing compartment that opens upwardly, said housing shaped for defining a fan-mounting space that is disposed above said liquid-containing compartment and said housing being formed with a vapor outlet, said humidifier housing further defining a wheel-receiving space between said liquid-containing compartment and said fan-mounting space;

a fan mounted in said fan-mounting space and operable so as to generate air currents that flow out of said humidifier housing through said vapor outlet; and a water wheel device including a wheel axle mounted rotatably in said wheel-receiving space, at least one disc member mounted rotatable on said wheel axle, each of said disc members having a lower disc portion extending into said liquid-containing compartment, and an upper disc portion disposed under and adjacent to said fan;

a drive motor mounted at said humidifier housing and coupled to said at least one disc member for driving axial rotation of said at least one disc member;

each of said disc members includes:

a disc body having an axle mounting portion mounted on said wheel axle, and a plurality of disc extension portions that extend in radially outward directions from said axle mounting portion and that are angularly spaced apart from each other, said disc body having first and second sides; and a cover unit mounted on said first side of said disc body and cooperating with said disc body to form a plurality of first liquid-receiving recesses in said second side of said disc body, each of said first liquid-receiving recesses being disposed between a corresponding adjacent pair of said disc extension portions;

said cover unit includes a plurality of cover plates, each said cover plate extends between an adjacent pair of said disc extension portions, said cover plates further cooperating with said disc body to form a plurality of second liquid-receiving recesses in said first side of said disc body, each of said second liquid-receiving recesses being disposed between a corresponding adjacent pair of said cover plates;

each of said second liquid-receiving recesses has a width that is gradually increased in a direction away from said wheel axle and opens at a periphery of said disc body;

adjacent ones of said cover plates are formed with end protrusions that cooperate to form a restricted access opening into the corresponding one of said second liquid-receiving recesses at the periphery of said disc body;

whereby liquid contained in said liquid-containing compartment is agitated when said at least one disc member rotates and is subsequently vaporized by the air currents generated by said fan.

* * * * *